US011090658B2

(12) United States Patent
Pallmann

(10) Patent No.: US 11,090,658 B2
(45) Date of Patent: Aug. 17, 2021

(54) DEVICE AND METHOD FOR PROCESSING OF FEED MATERIAL

(71) Applicant: PALLMANN MASCHINENFABRIK GmbH & Co. KG, Zweibruecken (DE)

(72) Inventor: Hartmut Pallmann, Zweibruecken (DE)

(73) Assignee: PALLMANN MASCHINENFABRIK GmbH & Co. KG, Zweibruecken (DE)

( * ) Notice: Subject to any disclaimer, the term of this patent is extended or adjusted under 35 U.S.C. 154(b) by 1121 days.

(21) Appl. No.: 14/929,637

(22) Filed: Nov. 2, 2015

(65) Prior Publication Data

US 2016/0121333 A1 May 5, 2016

(30) Foreign Application Priority Data

Oct. 31, 2014 (DE) ..... 10 2014 015 964.7

(51) Int. Cl.
*B02C 23/38* (2006.01)
*B02C 13/18* (2006.01)
(Continued)

(52) U.S. Cl.
CPC ..... *B02C 23/38* (2013.01); *B02C 13/18* (2013.01); *B02C 13/1835* (2013.01);
(Continued)

(58) Field of Classification Search
CPC ..... B02C 23/38; B02C 23/18; B02C 23/24; B02C 13/18; B02C 13/1835;
(Continued)

(56) References Cited

U.S. PATENT DOCUMENTS 5,215,262 A 6/1993 Binder
5,277,370 A * 1/1994 Schatz ..... B02C 13/1835 241/80
2007/0114308 A1* 5/2007 Andreae-Jackering ..... B02C 13/14 241/5

FOREIGN PATENT DOCUMENTS

AT 227515 B * 5/1963
DE 36 17 746 A1 12/1987
(Continued)

OTHER PUBLICATIONS

English translate (AT227515B), retrieved date Dec. 20, 2019.*
English translate (WO9007379A1), retrieve date May 21, 2020.*

*Primary Examiner* — Adam J Eiseman
*Assistant Examiner* — Mohammed S. Alawadi
(74) *Attorney, Agent, or Firm* — Muncy, Geissler, Olds & Lowe, P.C.

(57) ABSTRACT

A device and a method for processing feed material that has a housing, a material supply channel and a material discharge. The housing is axially divided into a first processing zone in which a rotor rotating around an axis is situated, and a second processing zone which adjoins the first processing zone in the flow direction of the feed material. In order to perform different processing procedures in one device the feed material is subject to a process gas by arranging a hollow body in the housing, coaxially to the axis for the formation of the second processing zone, which outer circumference is radially situated opposite the inner circumference of the housing, and which features at least one port at the end that is facing the rotor. A process gas, which can be fed to the feed material through at least one port, is applied to the hollow body.

16 Claims, 7 Drawing Sheets

(51) Int. Cl.

| | |
|---|---|
| ***B02C 23/20*** | (2006.01) |
| ***B02C 13/282*** | (2006.01) |
| ***B02C 23/24*** | (2006.01) |
| ***B02C 23/18*** | (2006.01) |
| ***B02C 18/12*** | (2006.01) |
| ***B02C 18/16*** | (2006.01) |
| ***B02C 18/22*** | (2006.01) |

(52) U.S. Cl.
CPC ..... *B02C 13/282* (2013.01); *B02C 23/18* (2013.01); *B02C 23/20* (2013.01); *B02C 23/24* (2013.01)

(58) Field of Classification Search
CPC ..... B02C 13/252; B02C 23/20; B02C 13/282; B02C 18/12; B02C 18/06; B02C 18/16; B02C 18/2216; B02C 18/2225
USPC ..... 241/57, 60, 152.2
See application file for complete search history.

(56) References Cited

FOREIGN PATENT DOCUMENTS

| | | | | |
|---|---|---|---|---|
| DE | 38 44 178 | A1 | 7/1990 | |
| DE | 197 23 705 | C1 | 1/1999 | |
| DE | 198 23 563 | A1 | 12/1999 | |
| WO | WO-9007379 | A1 * | 7/1990 | ..... B02C 23/32 |

* cited by examiner

DEVICE AND METHOD FOR PROCESSING OF FEED MATERIAL

This nonprovisional application claims priority under 35 U.S.C. § 119(a) to German Patent Application No. DE 10 2014 015 964.7, which was filed in Germany on Oct. 31, 2014, and which is herein incorporated by reference.

BACKGROUND OF THE INVENTION

Field of the Invention

The invention relates to a device for processing feed material and to a method for processing feed material.

Description of the Background Art

When processing feed material, it is not always possible to attain the desired features of the end product in respect of shape, size, surface, composition and the like, in one single processing step. For example, in heat-sensitive substances, a too intense processing of the feed material leads to an undesirably high heat input into the product. It is also possible that the product particles obtain a sticky surface during processing which leads to clumping during the subsequent bagging.

For this reason, it is known to process feed material in stages, in successive processing stations, wherein each respective machine of a processing station is tailored to the type of feed material and the desired features of the end product.

This approach facilitates the production of a high-quality end product. However, in economic terms, it is often unfavorable, due to the need for providing multiple machines and sufficient space as well as the need for required transports between the processing stations. In addition, because of the spatial separation of two processing stations, processing procedures immediately following one another, or those that overlap, cannot be performed.

For these reasons, devices have been developed with which two or more successive processing steps within one device can be performed. For example, DE 197 23 705 C1, which is incorporated herein by reference, describes a whirlwind mill having a housing in which a rotor fitted with grinding elements interacts with a fixed stator for processing the feed material. In the housing section on the input side, a mechanical comminution of the feed material takes place between the grinding elements and the stator, and in the subsequent housing section, an autonomous comminution of the already comminuted particles in the vortex field. Such devices have proven very successful in practice.

In addition, from DE 198 23 563 A 1, a device for grind drying cellulose derivatives is known, wherein during the increase of the apparent density of the end product, wet grinding takes place on the input side of the grinding zone. If applicable, water may be added here to the grinding gap, while via an introduction of hot air, the feed material is dried in the subsequent grinding zone.

SUMMARY OF THE INVENTION

It is therefore an object of the invention to provide a device and a method with which the execution of multiple, consecutive processes within the device in a preferably wide range of applications is possible.

In an exemplary embodiment, a flow of gas-solids is combined with at least one flow of process gas for performing various processing procedures in one device. The feed material as a solid phase of the gas-solid flow is thereby processed in the first processing zone, while the second processing zone, which may completely or partially overlap with the first processing zone, is combined with the process gas flow, which acts upon the second processing of the feed material. According to the invention, the process gas flow is thereby guided directly into the area of the first processing zone and/or the second processing zone with the help of a hollow body situated downstream of the first processing zone. It is advantageous to not feed the process gas punctually but instead over the entire circumference of the hollow body, so that the effect generated by the process gas uniformly occurs in the annulus that is formed by the hollow body and the housing wall.

A further advantage of the invention lies in the numerous options for performing and combining different processing procedures. Suitable process gases for this purpose are, for example, atmospheric air, steam, carbon dioxide, nitrogen and the like, which can feature a predetermined temperature and/or moisture content and/or other solids. In this way, the process gas can serve, for example, to cool the feed material processed in the first processing zone in order to offset the heat input into the feed material that was created during processing. To achieve a mechanical-physical effect, the feed material can also be quenched with an extremely cold process gas or be acted upon by a hot and/or dry process gas for thermal post-treatment or drying of the processed feed material. By adjusting the moisture content of the process gas, it is possible to control the process moisture that is present during material processing.

Alternatively or cumulatively, it is possible to supply further substances to the feed material using the process gas as a carrier gas. In the simplest case, a material mixture is hereby created from feed material and additional material, wherein the mixing ratio can be specified via the corresponding flow rate of the process gas flow or the feed material flow.

In another processing mode, the supplied material can be used to coat the material particles exiting from the first processing zone. The material hereby settles on the surface of the particles from the first processing step and bonds with them.

The supplied material can also serve to reduce a possibly existing tendency of the material particles to agglomerate, for example via pulverization. Conversely, it is also possible to supply the feed material with substances that form agglomerate with the material particles or promote the agglomeration of individual material particles.

A further possibility that opens up is to supply a reactive substance for the conversion of the comminuted material. This results in a chemical reaction between the feed material and the substance. If, however, a catalytic substance is added to the feed material with the process gas flow, an acceleration of the process can be achieved. In addition, in a potentially explosive environment, an inert gas can be fed as process gas into an inventive device in order to guarantee effective explosion prevention.

Advantageously, the hollow body is open at the end for the formation of the at least one port, so that the process gas can utilize the entire cross-section of the hollow body as a flow chamber, which effects a uniform and homogenous perfusion.

According to an embodiment of the invention, the hollow body ends at a clear, axial distance from the rotor, so that the lower edge of the hollow body forms a circumferential flow edge for the process gas. This way, a circumferential passage gap emerges between the rotor and the hollow body, via which the process gas can be fed uniformly distributed over the circumference of the second processing zone. Preferably, the axial height of the passage gap and consequently, the flow speed of the process gas, are adjustable, in that the hollow body and/or the rotor are axially displaceable by means of a displacement device.

According to an embodiment, the hollow body connects with its at least one port to the rotor. The process gas enters through the port into the rotor, from where it radially reaches the first processing zone. In this embodiment, the first and second processing zones thus completely or partially overlap, so that the effect takes place simultaneously. For example, in this way, an inert environment can be created in the first processing zone as a preventive measure against explosions.

In an embodiment, the rotor can have a baffle plate which defines the axial overlapping area between the first processing zone and the second processing zone. With this, it is possible to specify the start of the second material processing from within the first material processing. For example, a rise in temperature beyond a limit value during the first processing can be offset by supplying cooling gas in the last third of the first processing zone.

In order to preferably focus the cooling or heating effect of the process gas on the area of the at least one port in the hollow body, a further embodiment of the invention provides thermally isolating the hollow body from the annulus. If, however, the aim is for a heat exchange with the annulus to take place via the lateral surface of the hollow body, the hollow body can be fitted for this purpose with heat exchange surfaces, preferably at its inner side.

The geometry of the annulus formed by the housing and the hollow body is preferably determined by the shape of the hollow body. A cylindrical, preferably circular-cylindrical design of the hollow body results in a radial width of the annulus that is constant along the axial height, providing constant flow conditions for the feed material. In order to obtain certain parameters such as resting time, flow speed, settling behavior and the like, it can be useful, however, for the hollow body to be conical in shape, whereby the annulus broadens upwards or downwards.

In addition, it has been proven to be advantageous to dispose at least one nozzle for spraying in a fluid, preferably water, in the area of the material feed and/or the first processing zone and/or the second processing zone. The evaporation of the water binds excess thermal energy which could otherwise cause thermal damage to the feed material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
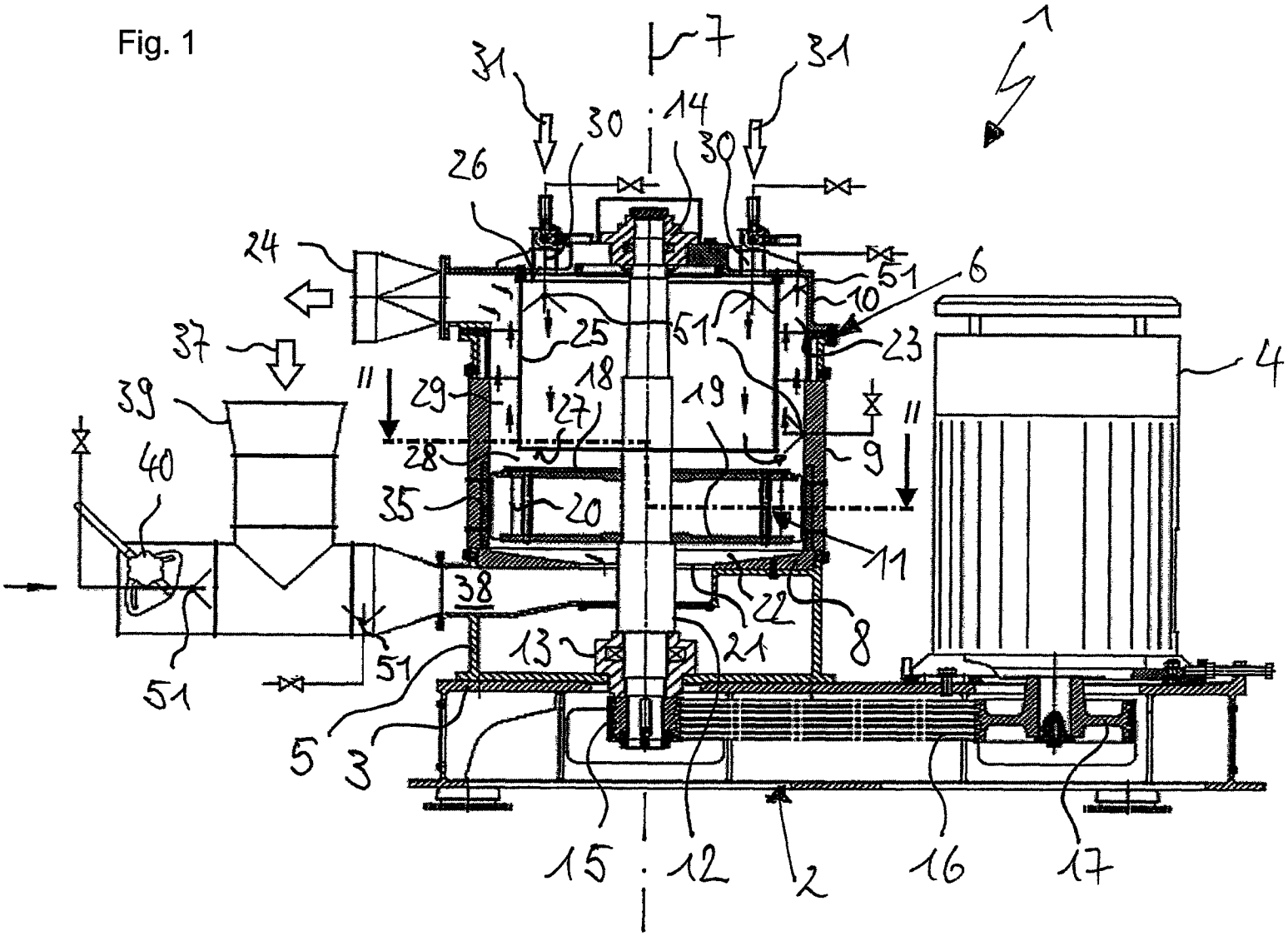
FIG. 1 illustrates a longitudinal cross-section through a device according to an embodiment of the invention, along the line I-I shown in FIG. 2.
Figure 2:
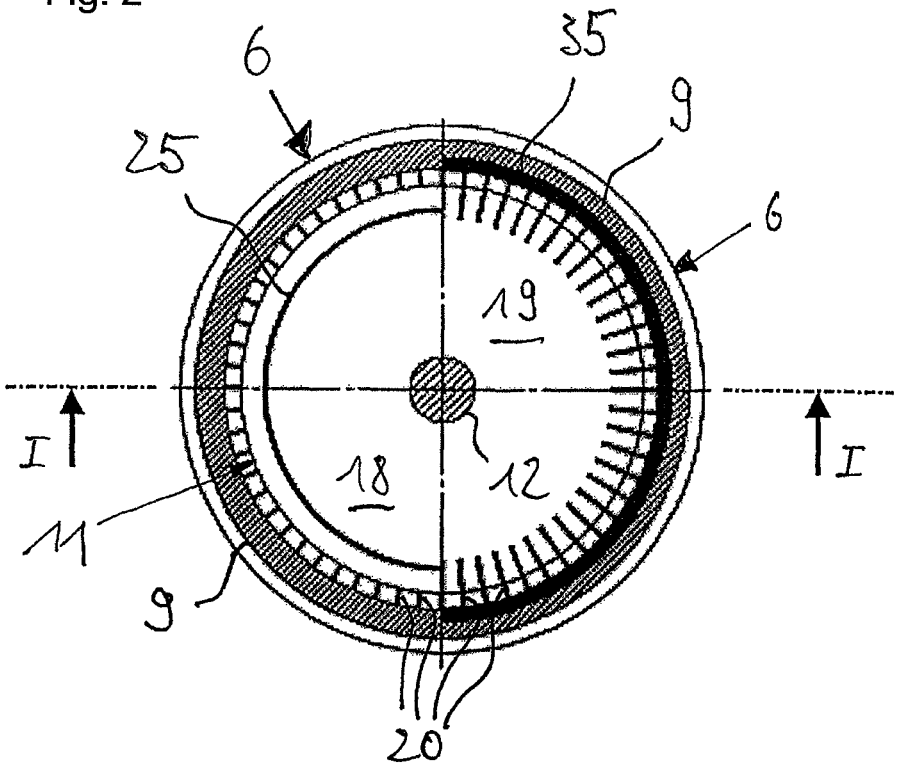
FIG. 2 illustrates a cross-section through the device shown in FIG. 1, along the line 11-11 shown there.
Figure 3:
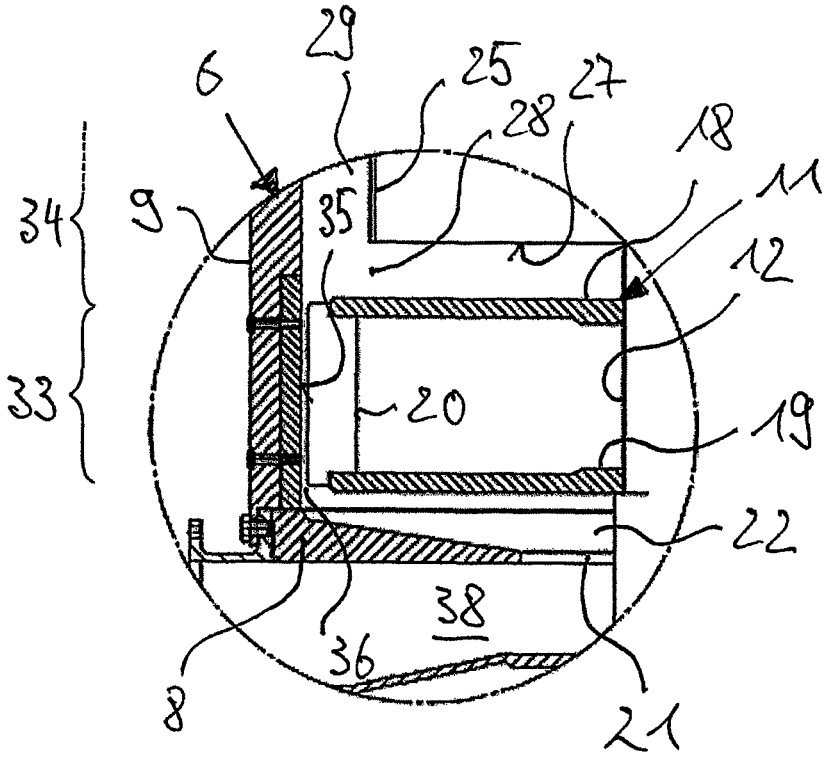
FIG. 3 illustrates a detail of the device illustrated in FIG. 1, in the area of the first and second processing zone.

FIGS. 1 to 3 show a first embodiment of a device according to the invention 1 in terms of a whirlwind mill which serves for fine grinding and pulverization of synthetic materials such as duroplasts, thermoplasts and elastomer. The device 1 comprises a platform-like machine base 2 which ends upwards in a horizontal mounting plate 3, on which a rotary drive 4 and a support frame 5 are mounted adjacent to one another. Securely connected to the support frame 5 is a cylindrical housing 6 which housing axis is oriented perpendicular to the mounting plate 3 and is defined by the reference number 7. The housing 6 is subdivided in axial direction into an input-sided housing section 8, a central cylindrical housing section 9 and a discharge-sided housing section 10.

A rotor 11 with a drive shaft 12 situated coaxially to the axis 7 is disposed inside the housing. The drive shaft 12 is rotatably mounted with its lower end section at a lower bearing 13, and its opposite end section at an upper bearing 14. The end of the drive shaft 12 protruding through the mounting plate 3 supports a multi-groove plate 15 which is coupled via a drive belt 16 to the multi-groove plate 17 of the rotary drive 4.

Inside the housing 6, an upper support disc 18 and a plane-parallel, lower support disc 19 at an axial distance therefrom, are situated perpendicular to the axis on the drive shaft 12 and rotate with the drive shaft 12. At their periphery, the support discs 18 and 19 feature position slots for receiving axially, parallel running impact plates 20 which in this way spread out in a ring across the circumference. During the operation of an inventive device, these then move with a peripheral speed of between about 100 m/sec and 180 m/sec, depending on the product.

The input-sided housing section 8 downwardly forms the housing termination situated at the end, and features a concentric input port 21 for the feed material, which surrounds the drive shaft 12 at a clear, radial distance in the area of the axis 7. Via the axial thickness of the input-sided housing section 8, an input port 21 evolves into a flat-tapered expansion, which with the lower perpendicular support disc 19, forms a distribution chamber 22 which tapers radially outwards and ensures an acceleration of the feed material in this area. The discharge-sided housing section 10 forms the upper, frontal housing termination and there, houses an annular channel 23 which runs concentric to the axis 7 and transitions into a material discharge 24 which protrudes tangentially from the housing section 10.

On the side facing the housing interior of the discharge-sided housing section 10, a cylindrical hollow body 25 is coaxially disposed to the axis 7. With its upper edge 26, the hollow body 25 forms a sealed connection to the discharge-sided housing section 10. The axial length of the hollow body 25 is such that the lower edge 27 of the hollow body 25 ends in a clear, axial distance from the upper support disc 18 of the rotor 11. This way, a passage gap 28 concentric to the axis 7 is created. The diameter of the hollow body 25 is smaller than the diameter of the rotor 11, which creates an available annulus 29 at the inner wall of the housing 6. The annulus 29 is downwardly open in the direction of the rotor 11 and upwardly ends in the annular channel 23.

The discharge-sided housing section 10 further features axially oriented nozzles 30, via which a process gas 31 can be fed into the cavity that is encased by the hollow body 25. Using armatures 51, the amount of the process gas 31 that is introduced can be adjusted.

The central, cylindrical housing section 9 is subdivided in axial direction into a first processing zone 33 and a second processing zone 34 (FIG. 3). The first processing zone 33 connects directly to the input-sided housing section 8, and is substantially formed by a baffle web 35 which is disposed at the inner circumference of the central housing section 9 and forms a grinding gap 36 with the impact plates 20 of the rotor 11. The second processing zone 34 connects in axial direction directly to the first processing zone 33 and extends in axial direction through the passage gap 28 and the annulus 29 to the annular channel 23.

The loading of the device 1 with feed material 37 takes place via a supply channel 38 which can be filled with feed material 37 through a feed hopper 39. To regulate the amount of air flowing through the device 1, a damper 40 is integrated in the supply channel 38, with which the effective flow cross-section in this area can be set.

When operating a device 1 according to the invention, the feed material 37 reaches the input port 21 as a gas-solid mixture over the supply channel 38, through which it flows into the housing interior and first reaches the distribution chamber 22. Here, the feed material 37 is deflected in radial direction and accelerates towards the grinding gap 36. In the grinding gap 36, the feed material 37 flows upwards, helically around the axis 7, and is subjected to grinding in the first processing procedure.

At the same time, the process gas 31, in this case cooling gas, is fed via the nozzles 30 into the hollow body 25. The process gas 31 then flows over the lower edge 27 of the hollow body 25, and after passing through the passage gap 28, reaches the annulus 29, where an intermixing of the comminuted feed material 37 takes place, which, conveyed by air, has also entered the annulus 29, and there encounters the process gas 31. During intermixing of the feed material 37 and the process gas 31, interactions occur which are responsible for the course of the second processing procedure. In the present case, the second processing procedure includes a sudden cooling of the comminuted feed material 37.

Furthermore, feed material 37 and process gas 31 helically flow through the annulus 29 until they reach the annular channel 23 and are discharged via the material discharge 24 from the inventive device.

Figure 4:
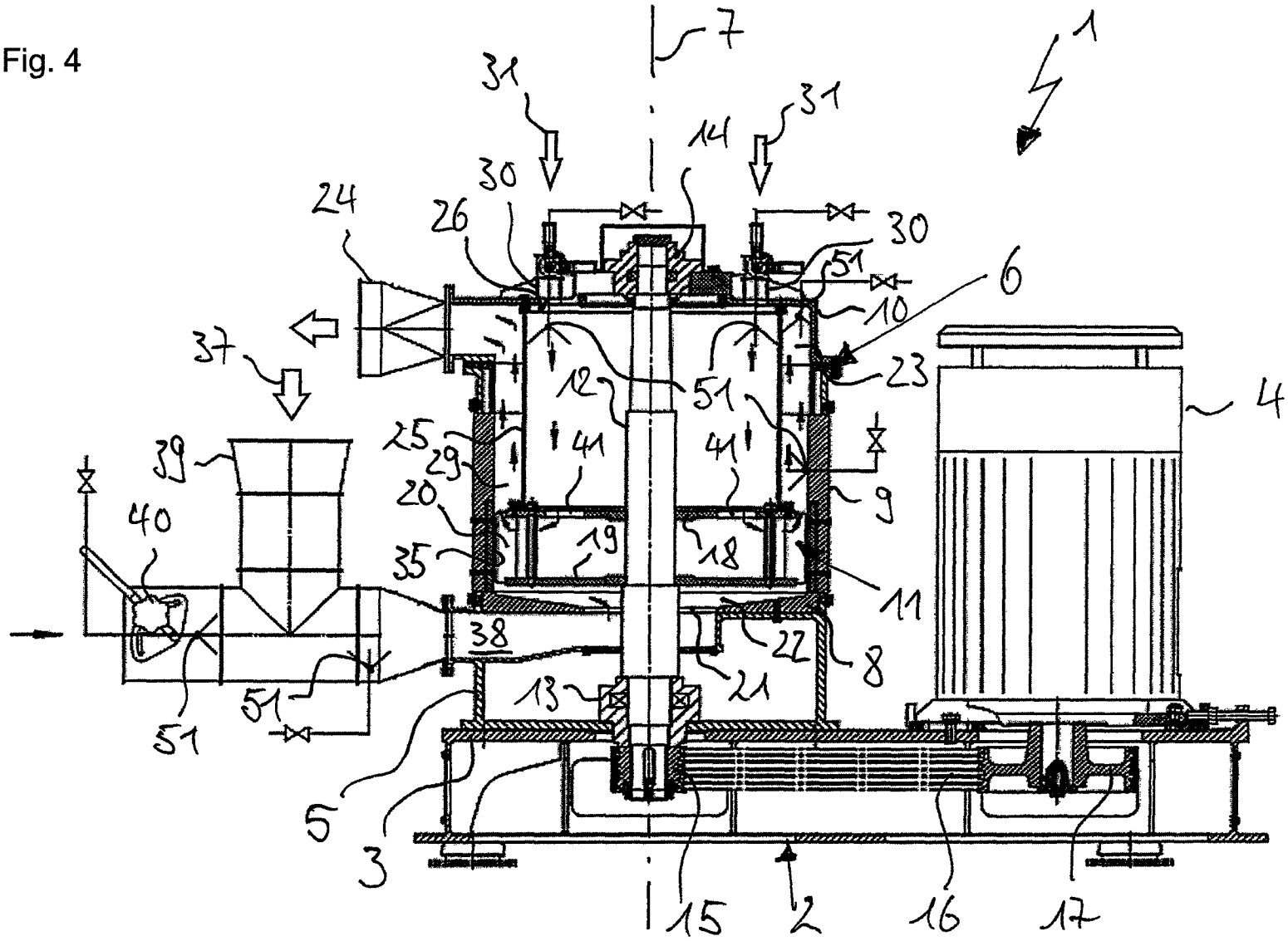
FIG. 4 illustrates a longitudinal cross-section through an embodiment of the invention.

The device 1 shown in FIG. 4 largely corresponds to the one described in FIGS. 1 to 3. In comparison thereto, ports 41 are disposed in the upper support disc 18, and the lower edge 27 of the hollow body 25 is tightly connected with the support disc 18, for which purpose, for example, a sliding seal 42 (FIG. 6) may be provided. The process gas 31 is thereby guided through the hollow body 25 that is open at the end, through the ports 41 in the area between the upper support disc 18 and the lower support disc 19, and there, is accelerated radially outwards by the rotor 11, where it reaches the grinding gap 36 by transiting between the impact plates 20.

In this embodiment, the intermixing of the feed material 37 with the process gas 31 already starts in the grinding gap 36 and continues in the adjoining annulus 29. This way, the first processing procedure and the second processing procedure take place simultaneously.

Figure 5:
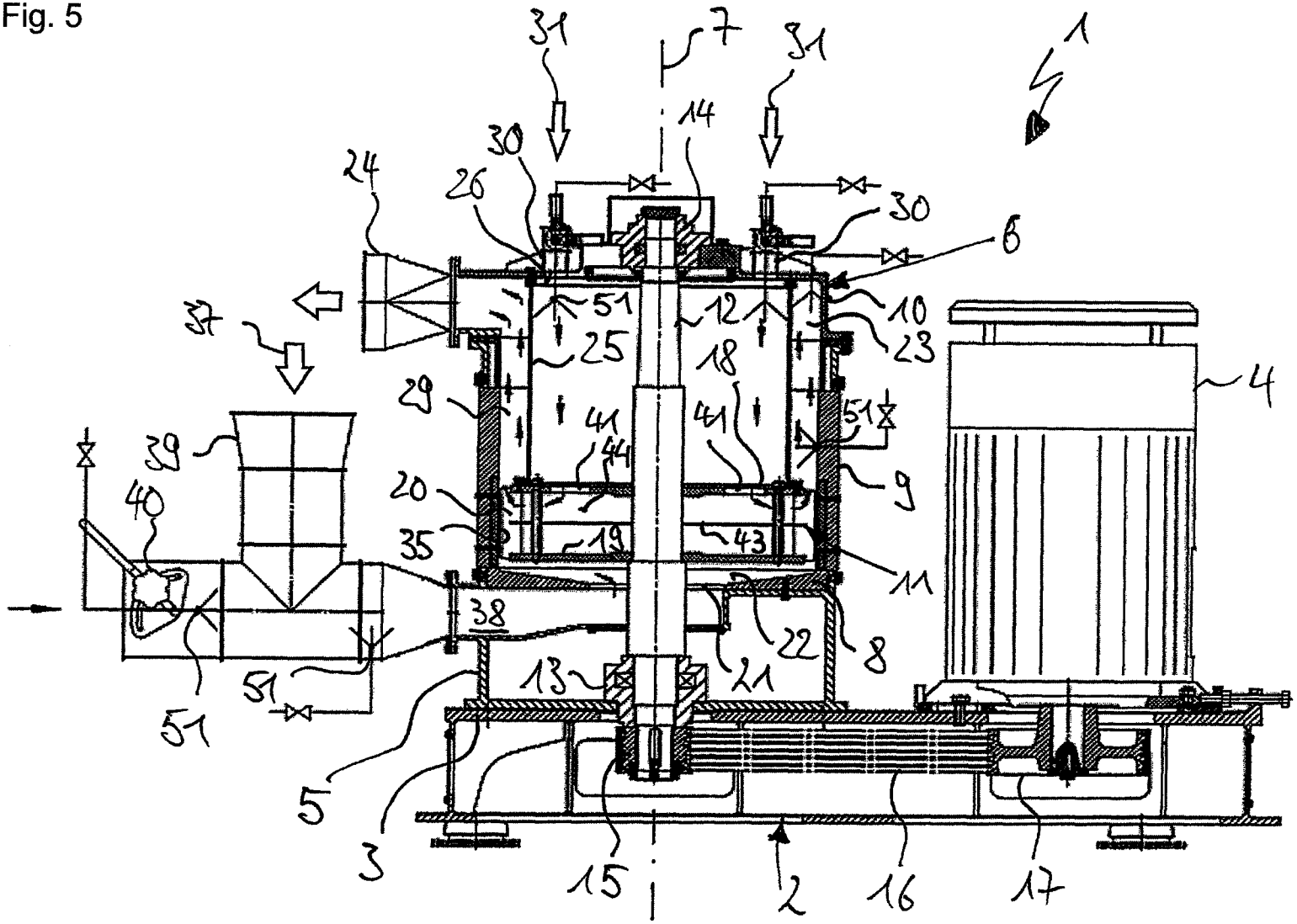
FIG. 5 illustrates an embodiment of a device according to the invention.
Figure 6:
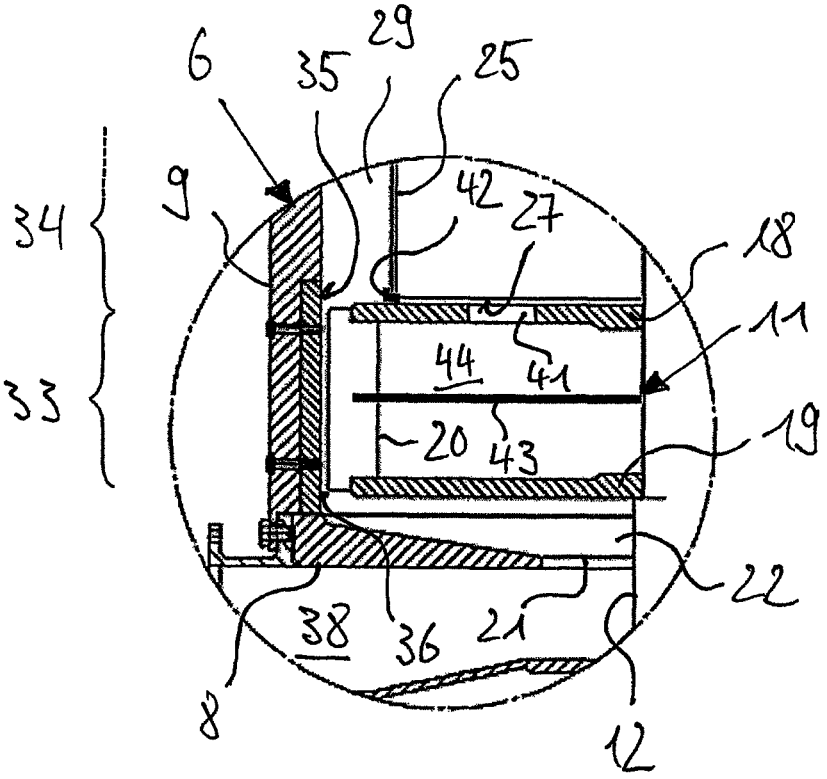
FIG. 6 illustrates a detail of the device illustrated in FIG. 5, in the area of the first and second processing zone.

FIGS. 5 and 6 disclose a further embodiment of the device shown in FIG. 4, wherein the rotor 11 is supplemented by a circular baffle plate 43, which is disposed plane-parallel and concentric thereto between the upper support disc 18 and the lower support disc 19. This way, a disc-shaped flow chamber 44 is created between the upper support disc 18 and the baffle plate 43, in which the process gas 31 flows radially outwards in the end section of the grinding gaps 36. So in contrast to the embodiment described above, the feed material 37 and the process gas 31 only mix in the end region of the grinding track 36, which results in a spatial and temporal overlapping of the first processing procedures and the second processing procedures.

Figure 7:
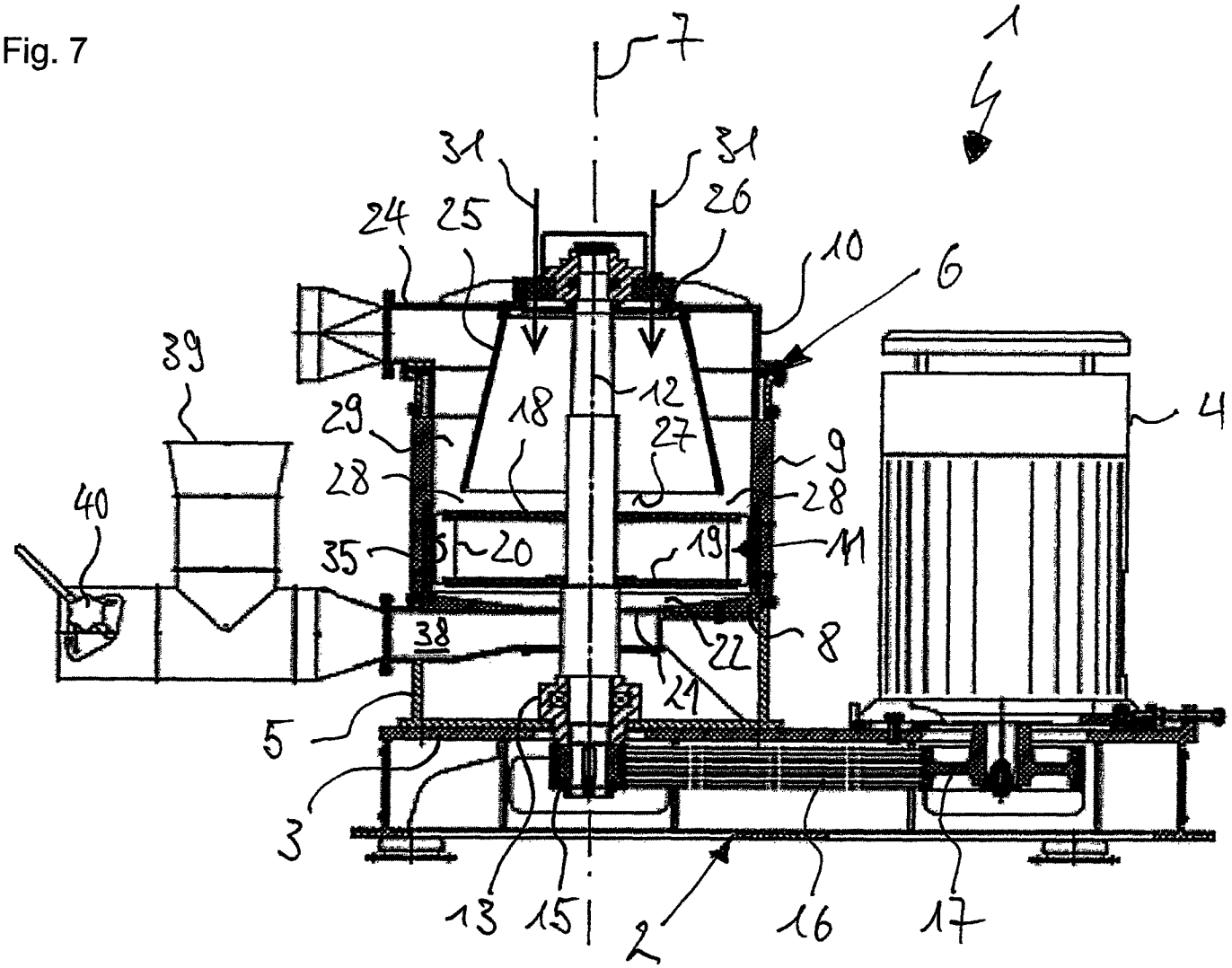
FIG. 7 illustrates a longitudinal cross-section through an embodiment of the invention.

FIG. 7 relates to a variation of the inventive device described above, in which the hollow body 25 does not have a hollow cylindrical shape, but instead is formed conically. In the exemplary embodiment shown, the upper edge 26 has a lesser circumference than the lower edge 27. Because of this, the annulus 29 broadens in the direction of the annular channel 23. This way, the feed material entering the annulus 29 receives a higher volume and a longer resting time in the annulus 29, whereby the second processing procedure can last longer.

Figure 8:
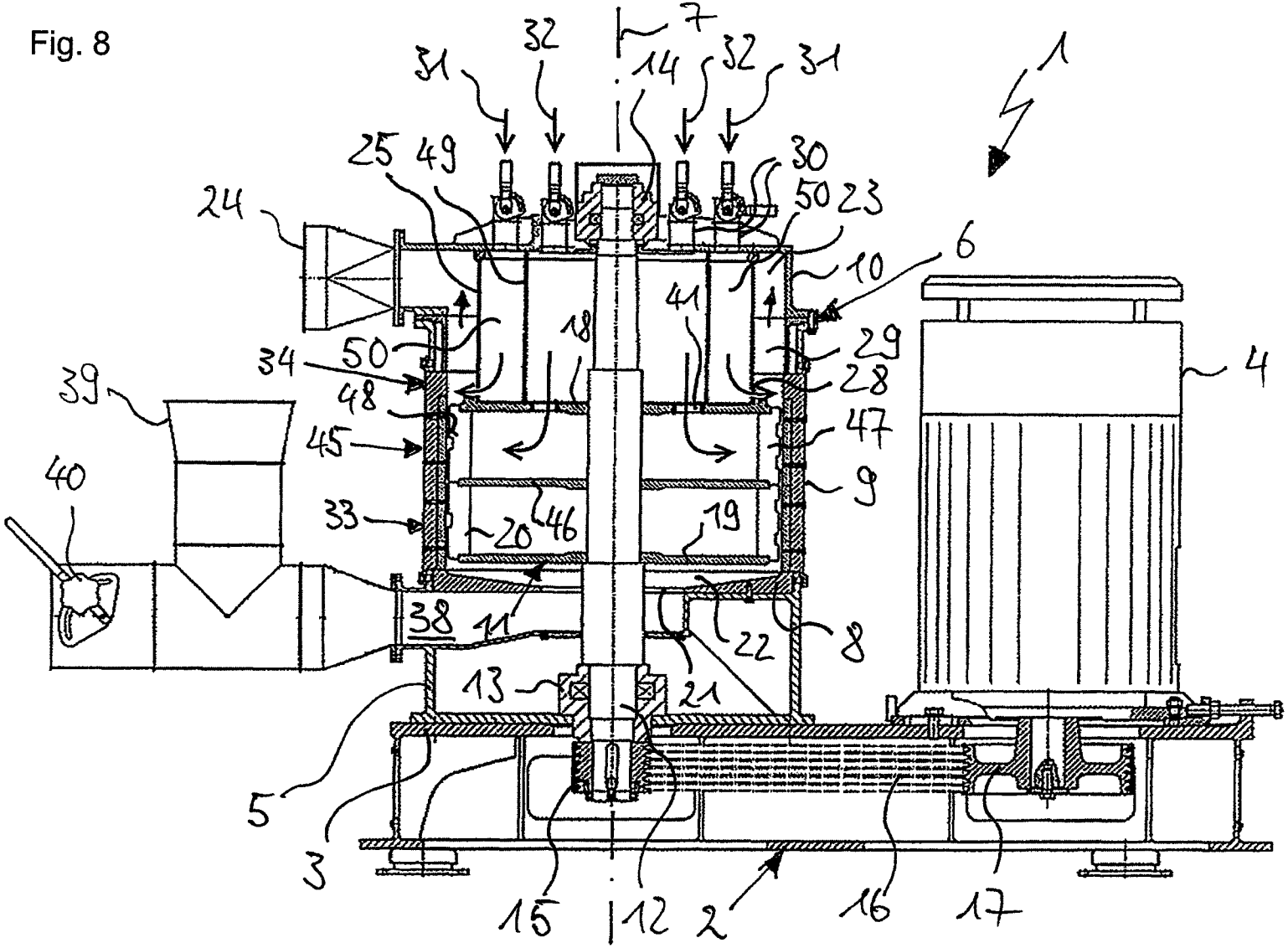
FIG. 8 illustrates a longitudinal cross-section through an embodiment of the invention.

The device shown in FIG. 8 illustrates an enhancement of the device and of the method by one, additional zone 45 for material processing within the device 1, which is interposed between the first processing zone 33 and the second processing zone 34. For this purpose, the rotor 11 is supplemented by an additional support disc 46 which is seated at a clear, axial distance, coaxially and plane-parallel between the upper support disc 18 with ports 41 and the lower support disc 19 on the axis 7. The impact plates 20 of the first processing zone 33 are spread out in a ring over the circumference of the additional support disc 45 and the lower support disc 19, to which they are displaceably attached. The processing tools 47 of the additional processing zone 45 are accordingly disposed at the upper support disc 18 and the additional support disc 46 and are in turn surrounded by a stationary, active path 48, which can be designed in accordance with the additionally desired processing type. For example, the active path 48 can be formed by a baffle plate, which provides a second comminution stage in conjunction with processing tools 47 that effect a percussive action. Alternatively, the active path 48 and the processing tools 47 can create a vortex field for coating the material particles that originate from the first processing zone 33. The second processing zone 34 in turn corresponds to the one described in FIGS. 1 to 7.

To be able to feed process-specific process gas into the additional processing zone 45 and the second processing zone 34 independently of each other, an outer cylindrical hollow body 25 and additionally, an inner cylindrical hollow body 49 are disposed above the rotor 11 in the cavity encased by the housing 6, which are nested inside each other coaxially to the axis 7 and attached with their upper end at the discharge-sided housing section 10. This results in an inner annulus 50 between the two hollow bodies 25 and 49. The outer hollow body 25 ends with its lower edge at a clear, axial distance from the upper support disc 18, whereby in turn a passage gap 28 is formed, according to the embodiment in FIGS. 1 to 3. The inner hollow body 49 radially seals outside the ports 41 to the top surface of the upper support disc 18, according to the embodiments in FIGS. 4 to 6.

Such a design of a device 1 according to the invention allows the additional, second process gas flow 32 to be guided through the cavity surrounded by the inner hollow body 49, and through the ports 41 into the area between the upper support disc 18 and the additional support disc 46, where it is deflected in a radial direction and fed into the additional processing zone 45.

In contrast, the process gas flow 31 for the second processing zone 33 is transported in the way described above, inside the inner annulus 50 and between the outer hollow body 25 and the inner hollow body 49, through the peripheral passage gap 28 between the upper support disc 18 and the lower edge 27 of the outer hollow body 25, into the area of the second processing zone 33. For the type of material processing and the constructive design of the individual processing zones 33, 34 and 46, the embodiments from FIGS. 1 to 7 apply accordingly.

A simplified—not shown—embodiment of the one shown in FIG. 8 is to simply omit the additional processing zone 45. In this case, the rotor 11 only has an upper support disc 18 with ports 41 and a lower support disc 19, wherein the hollow body 25 ends in axial distance from the upper support disc 18 by forming a passage gap 28, and the inner hollow body 49 connects tightly to the upper support disc 18, radially outside of the ports 41. This way, the first process gas flow 31 reaches the second processing zone 34 via the passage gap 28; the additional, second process gas flow 32 via the ports 41 into the area between the two support discs 18 and 19.

The invention being thus described, it will be obvious that the same may be varied in many ways. Such variations are not to be regarded as a departure from the spirit and scope of the invention, and all such modifications as would be obvious to one skilled in the art are to be included within the scope of the following claims. Also, it is understood that the invention is not limited to the feature combinations of the individual embodiments, but also comprises combinations of features of different embodiments insofar as these are readily understandable by those skilled in the art.

What is claimed is:

1. A device for processing feed material comprising:

a housing arranged along an axis, the housing comprising:

a first processing zone within the housing, in which a rotor rotating around the axis is arranged, which is equipped with rotor tools about a circumference thereof, while maintaining a radial grinding gap that interacts with stator tools arranged at an inner circumferential wall of the housing;

a second processing zone within the housing, the second processing zone adjoining and being downstream of the first processing zone in a flow direction of the feed material, such that the feed material is processed in the first processing zone before being processed in the second processing zone;

a material supply channel for supplying feed material to the first processing zone; and a material discharge for discharging the feed material that has been processed from the housing;

wherein, for forming the second processing zone, a hollow body is provided in the housing and is coaxially arranged to the axis, wherein a diameter of the hollow body is smaller than a diameter of the rotor, such that, in a radial direction, an outer circumferential wall of the hollow body is spaced apart from the inner circumferential wall of the housing to form an annulus therebetween, wherein the feed material flows through the annulus after being processed in the first processing zone and wherein the hollow body has at least one port at a lower end that faces the rotor, and wherein a process gas is supplied to an interior of the hollow body and is then supplied from the interior of the hollow body to the feed material through the at least one port of the hollow body, such that the process gas first passes through the hollow body and through the at least one port of the hollow body before being supplied to any portion of the feed material within the housing.

2. The device according to claim 1, wherein the at least one port is formed by an available, lower edge of the hollow body, which is open at the end.

3. The device according to claim 2, wherein the at least one port is arranged at a clear, axial distance from the rotor, and wherein the clear distance allows a radial passage of the process gas into the annulus.

4. The device according to claim 1, wherein the hollow body abuts with its at least one port at the rotor and the process gas is radially fed to a grinding gap through ports in the rotor.

5. The device according to claim 4, wherein the rotor has an upper support disc and a lower support disc, at which circumference the rotor tools are disposed, wherein the upper support disc has ports for feeding the process gas, and wherein between the upper support disc and the lower support disc a baffle plate is disposed.

6. The device according to claim 1, wherein the hollow body has a cylindrical shape.

7. The device according to claim 1, wherein the hollow body has a conical shape, and wherein the annulus widens or narrows over an axial length of the hollow body.

8. The device according to claim 1, wherein, in the area of the material feed and/or the first processing zone and/or the second processing zone, at least one nozzle is arranged for spraying in a fluid.

9. The device according to claim 1, wherein, inside the outer hollow body, an inner hollow body is arranged by forming an inner annulus, wherein the outer hollow body ends with its lower edge in a clear, axial distance from the upper support disc and the inner hollow body tightly connects with its lower edge at the upper support disc, wherein a first process gas flow is applied to the inner annulus and a second process gas flow is applied to the cavity inside the inner hollow body.

10. The device according to claim 1, wherein, between the upper support disc and the lower support disc, an additional support disc is arranged, wherein a device section between the upper support disc and the additional support disc forms an additional processing zone, wherein a second process gas flow is applied to the additional processing zone, and wherein a first process gas flow is applied to the second processing zone.

11. The device according to claim 1, wherein the outer circumferential wall of the hollow body is spaced apart from the inner circumferential wall of the housing, and wherein a space formed between the outer circumferential wall of the hollow body and the inner circumferential wall of the housing forms the annulus.

12. The device according to claim 1, wherein the annulus is axially aligned with the grinding gap along the inner circumferential wall of the housing.

13. The device according to claim 1, wherein a lower edge of the hollow body is arranged parallel to and opposes an upper support disk of the rotor, wherein the lower edge of the hollow body is spaced apart from the upper support disk of the rotor to form a passage gap for the process gas supplied from the hollow body, and wherein a lower support disk of the rotor faces an input port of the material supply channel.

14. The device according to claim 1, wherein the second processing zone is positioned within the housing between the first processing zone and the material discharge.

15. The device according to claim 1, wherein the at least one port of the hollow body is directly adjacent an upper support disk of the rotor with a passage gap provided therebetween for the passage of the process gas, such that the process gas flows out of the at least one port of the hollow body, then flows into the passage gap and then flows from the passage gap into the annulus to intermix with the feed material.

16. The device according to claim 15, wherein the process gas directly contacts the upper support disk of the rotor as the process gas flows through the passage gap.

* * * * *